US009162834B1

(12) United States Patent
Lee

(10) Patent No.: US 9,162,834 B1
(45) Date of Patent: Oct. 20, 2015

(54) FRONT-EDGE PAPER FEEDING DEVICE

(71) Applicant: Jun-Yen Lee, Taoyuan County (TW)

(72) Inventor: Jun-Yen Lee, Taoyuan County (TW)

( * ) Notice: Subject to any disclaimer, the term of this patent is extended or adjusted under 35 U.S.C. 154(b) by 0 days.

(21) Appl. No.: 14/538,934

(22) Filed: Nov. 12, 2014

(51) Int. Cl.

| | |
|---|---|
| ***B65H 3/06*** | (2006.01) |
| ***B65H 5/06*** | (2006.01) |
| ***B65H 3/08*** | (2006.01) |
| ***B65H 5/22*** | (2006.01) |
| ***B65H 3/12*** | (2006.01) |

(52) U.S. Cl.
CPC ..... *B65H 3/063* (2013.01); *B65H 3/085* (2013.01); *B65H 3/126* (2013.01); *B65H 5/068* (2013.01); *B65H 5/222* (2013.01); *B65H 2406/3122* (2013.01)

(58) Field of Classification Search
CPC ..... B65H 3/085; B65H 3/62; B65H 3/64; B65H 3/42; B65H 3/12; B65H 3/126; B65H 3/063; B65H 2406/30; B65H 2406/312; B65H 2406/3122
USPC ..... 271/132
See application file for complete search history.

(56) References Cited

U.S. PATENT DOCUMENTS

| | | | | | |
|---|---|---|---|---|---|
| 3,486,749 | A | * | 12/1969 | Billings | 271/112 |
| 4,614,335 | A | * | 9/1986 | Sardella | 271/112 |
| 4,828,244 | A | * | 5/1989 | Sardella | 271/11 |
| 4,889,331 | A | * | 12/1989 | Sardella | 271/11 |
| 4,896,872 | A | * | 1/1990 | Sardella | 271/11 |
| 5,026,040 | A | * | 6/1991 | Gibert | 271/35 |
| 5,074,539 | A | * | 12/1991 | Wells et al. | 271/12 |
| 5,184,811 | A | * | 2/1993 | Sardella et al. | 271/10.11 |
| 5,464,202 | A | * | 11/1995 | Capdeboscq | 271/11 |
| 5,531,432 | A | * | 7/1996 | Sardella | 271/10.01 |
| 7,621,524 | B2 | * | 11/2009 | Levin | 271/123 |
| 7,635,124 | B2 | * | 12/2009 | Sardella | 271/10.06 |

* cited by examiner

*Primary Examiner* — Patrick Cicchino
(74) *Attorney, Agent, or Firm* — Jackson IPG PLLC; Demian K. Jackson

(57) ABSTRACT

A front-edge paper feeding device is applicable for automatically conveying a stack of cardboards one by one. During operation, the stack of cardboards is placed on a grid plate, and a control element is provided for controlling the grid plate to elevate and descend reciprocally. When the grid plate elevates, the cardboards are separated from a conveyor wheel. When the grid plate descends, the conveyor wheel is exposed, such that the conveyor wheel is in contact with the cardboard. A servomotor is provided for controlling intermittent rotations of the transmission shaft while driving the conveyor wheel, so that the conveyor wheel drives the cardboard to move in order to convey and output the cardboard smoothly.

8 Claims, 7 Drawing Sheets

FRONT-EDGE PAPER FEEDING DEVICE

FIELD OF THE INVENTION

The present invention relates to a paper feeding device, in particular to a front-edge paper feeding device applicable for automatically and quickly conveying stacked cardboards at a front edge of different operating procedures.

BACKGROUND OF THE INVENTION

At present, corrugated cardboards are used extensively in our daily life for carrying, protecting, transporting, and storing objects. In the manufacture of corrugated cardboards, folding, preheating, corrugated molding, gluing, cooling, line pressing, trimming, cutting and stacking processes are used for making the corrugated cardboards, so that the corrugated cardboards can further be manufactured to produce cartons, paperboards and various forms of products for different purposes.

In a conventional front-edge paper feeding device of a corrugated carton machine, the paper feeding operation includes the steps of: continuously sucking and pulling the bottom corrugated cardboard of a stack of corrugated cardboards from a hollow platform at the front of the machine by an air extraction device, so that the corrugated cardboards are placed equidistantly with one another on the platform and slightly higher than a plurality of conveyor belts on the surface of the platform, and then transmitting each conveyor belt by a clutch mechanism to rub, drive and send the bottom corrugated cardboard into a transfer roller set in the machine, and then extracting the bottom corrugated cardboard of the stack of corrugated cardboards by the transfer roller set, and finally feeding the corrugated cardboard into the corrugated carton machine to carry out other manufacturing processes such as creasing, slotting, printing, and cutting processes.

However, the air extraction device has air extraction passages interconnected with each hollow position of the platform, so that the flow of the air extraction is distributed uncertainly all over the platform due to the size and area of the corrugated cardboard, and idle suctions occur frequently and cause unnecessary waste of energy. In this situation, the air extraction power must be increased. In addition, the extraction force varies with the area and idle suction position of the corrugated cardboard, so that different pressures may be exerted on the corrugated cardboard and its contact surface with each conveyor belt, and uneven wearing may occur. Therefore, the corrugated cardboard bears a conveying force with uneven frictions and results in a skew feed and affects the quality of transferring the corrugated cardboard from the transfer roller set for manufacturing operations at a later stage.

In view of the aforementioned problems and drawbacks of the prior art, the inventor based on years of experience in the related industry to conduct extensive researches and experiments, and finally designed and develop a front-edge paper feeding device in accordance with the present invention to provide quick delivery and smooth separation of paper materials and facilitate the operations in a later manufacturing process.

SUMMARY OF THE INVENTION

Therefore, it is a primary objective of the present invention to provide a front-edge paper feeding device applicable for automatically and quickly conveying stacked cardboards at a front edge of different operating procedures.

To achieve the aforementioned and other objectives, the present invention provides a front-edge paper feeding device comprising a plurality of transmission shafts, a grid plate, at least one servomotor, a control element and a suction box, wherein the transmission shaft includes a plurality of conveyor rollers axially installed to the transmission shafts, and the grid plate is covered onto the plurality of transmission shafts and controlled by the control element to elevate and descend reciprocally, and the transmission shaft is rotated intermittently by the servomotor. During operation, the cardboard is placed on the grid plate. When the grid plate elevates, the cardboard is separated from the conveyor wheel, and the control element controls the grid plate to elevate and descend reciprocally. When the grid plate descends, the conveyor wheel is exposed, so that the cardboard is in contact with the conveyor wheel, and the suction box drives the cardboard to fall quickly and attach onto the grid plate, and the servomotor is operated to rotate the transmission shaft while driving the conveyor wheel, so that the conveyor wheel drive the cardboard to move in order to convey and output the cardboard, so as to achieve the effects of feeding paper continuously and smoothly and conveying the cardboard intermittently.

DESCRIPTION OF THE PREFERRED EMBODIMENTS

The present invention will become clearer in light of the following detailed description of an illustrative embodiment of this invention described in connection with the drawings. It is intended that the embodiments and drawings disclosed herein are to be considered illustrative rather than restrictive.

Figure 1:
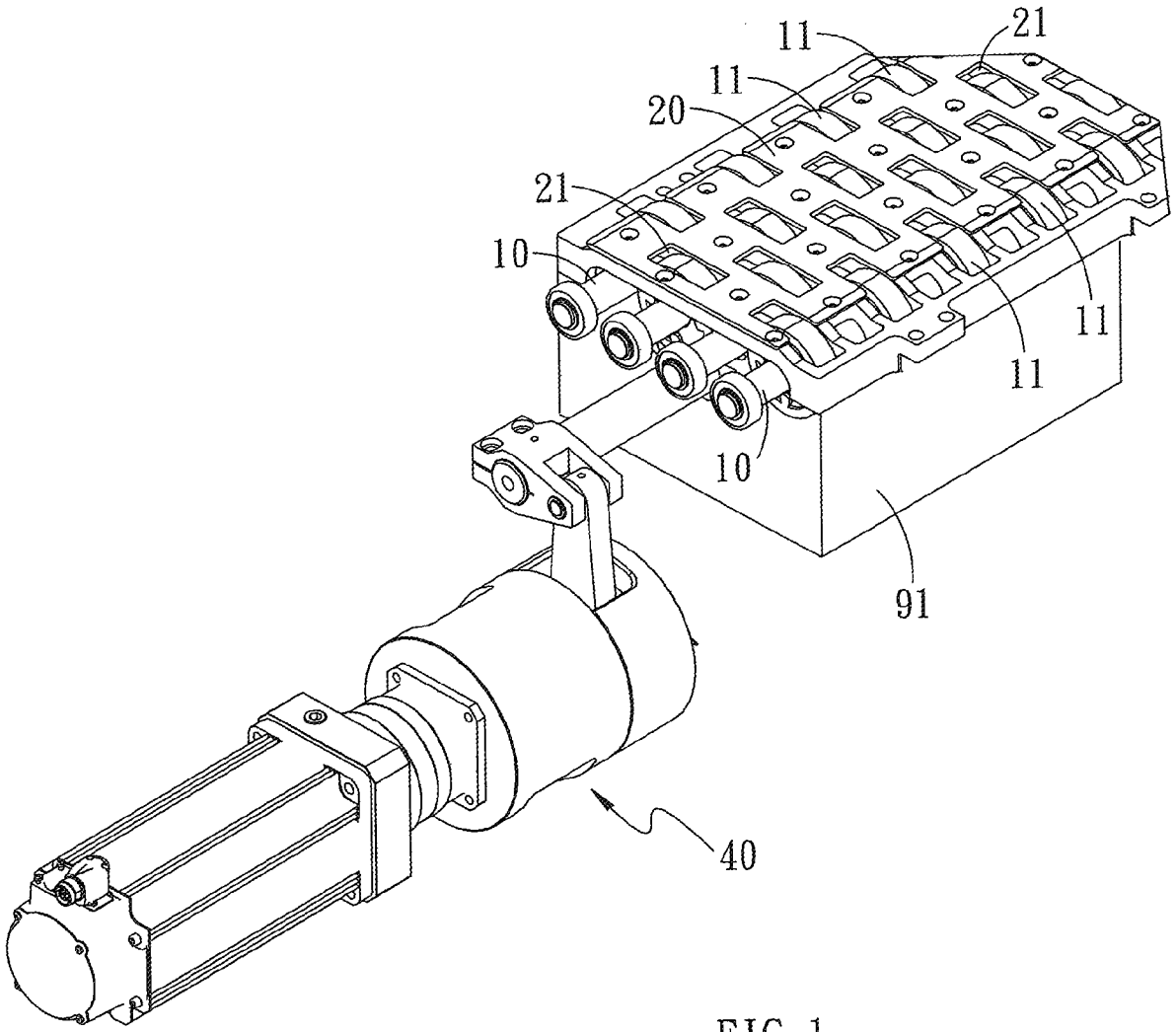
FIG. 1 is a perspective view of the present invention.
Figure 2:
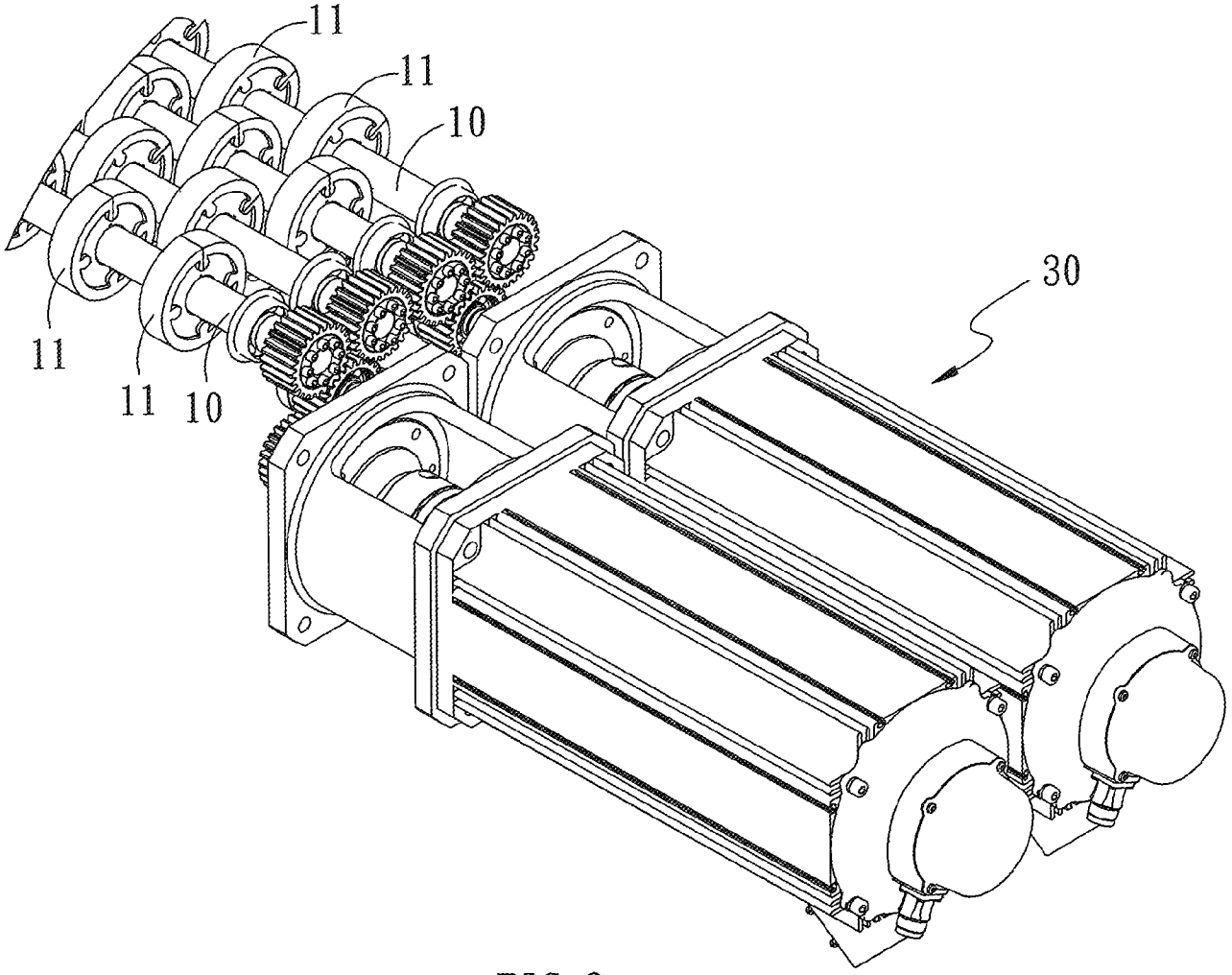
FIG. 2 is a schematic view of a partial structure of the present invention.

With reference to FIGS. 1 and 2 for a perspective view and a partial structural view of a front-edge paper feeding device of the present invention respectively, the front-edge paper feeding device comprises a plurality of transmission shafts 10, a grid plate 20, at least one servomotor 30, a control element 40 and a suction box 91.

The transmission shafts 10 are arranged parallel to each other, and the transmission shafts 10 are axially installed to a plurality of conveyor rollers 11 respectively.

The grid plate 20 is covered onto the plurality of transmission shafts 10, and the grid plate 20 includes a plurality of broken holes 21 formed at positions corresponsive to the plurality of conveyor rollers 11 respectively. The grid plate 20 is able to elevate and descend between the conveyor rollers 11.

The servomotor 30 is connected to the plurality of transmission shafts 10 for controlling the transmission shafts 10 to rotate intermittently.

The control element 40 is connected to the grid plate 20 for controlling the grid plate 20 to elevate and descend reciprocally.

The suction box 91 is installed under the transmission shafts.

Figure 3:
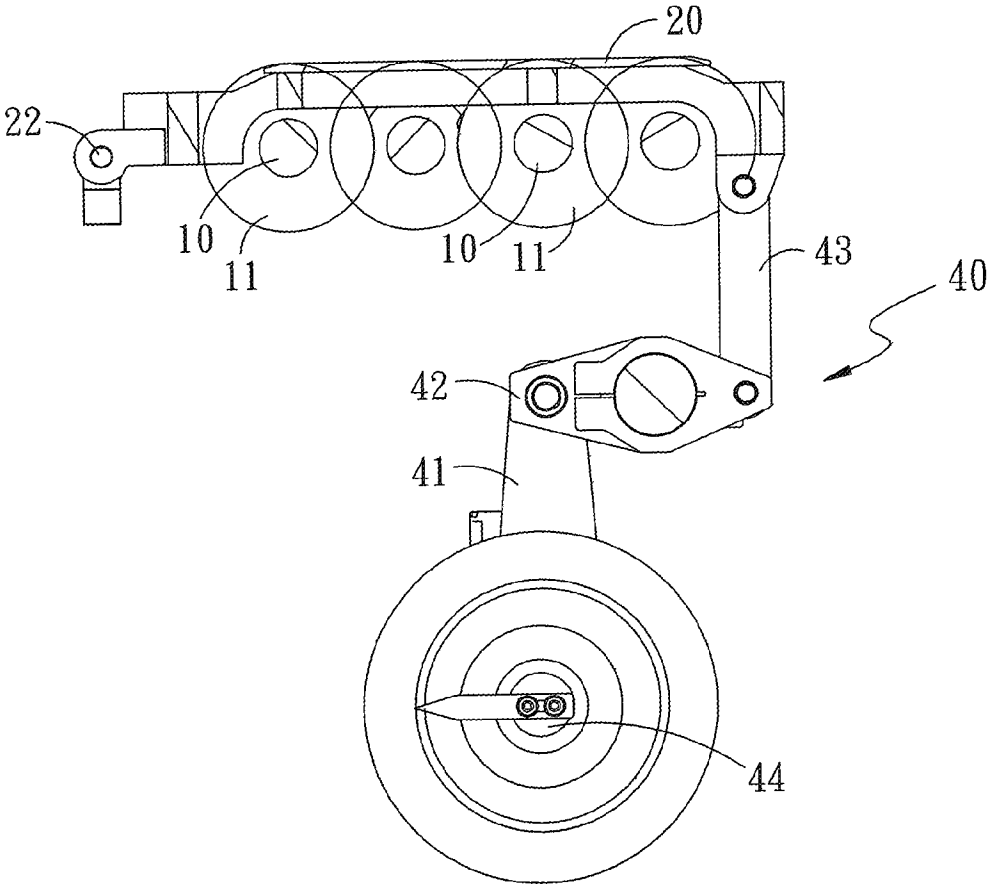
FIG. 3 is a schematic view of linking a grid plate of the present invention.
Figure 4:
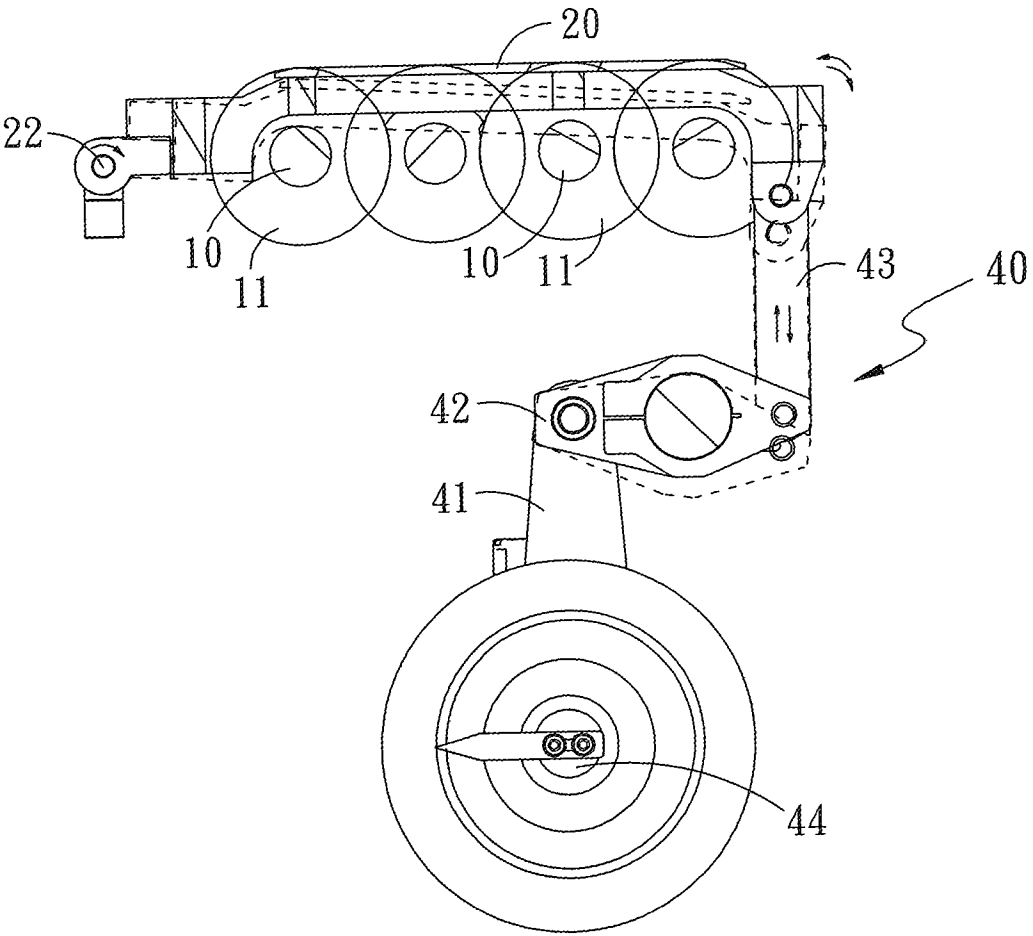
FIG. 4 is a schematic view of operating a grid plate of the present invention.

With reference to FIGS. 3 and 4 for an embodiment of the present invention, an end of the grid plate 20 is connected to the control element 40, and the other end of the grid 20 is installed with a shaft member 22, and the axis of the shaft member 22 acts as a fulcrum for rotation. In addition, the control element 40 includes a power shaft 41, a crank 42 and a link lever 43, wherein an end of the crank 42 is linked to the power shaft 41, and the other end of the crank 42 is linked to the link lever 43, and the power shaft 41 is pivotally connected to an eccentric wheel 44 and provided for driving the crank 42 to elevate and descend reciprocally through the eccentric wheel 44, and the crank 42 drives the link lever 43 to elevate or descend, and an end of the grid plate 20 is connected and fixed to the shaft member 22 which uses its axis as a fulcrum, and when the other end of the grid plate 20 is driven by the link lever 43, the grid plate 20 is elevated and descended reciprocally with a curvature.

When the present invention is operated on the grid plate 20, a stack of cardboards to be conveyed can be placed on the grid plate 20. When the grid plate 20 descends, the conveyor wheel 11 is exposed, so that the cardboard is in contact with the conveyor wheel 11, and the servomotor 30 is operated to drive the transmission shaft 10 to rotate intermittently, and the transmission shaft 10 synchronously drive the conveyor wheel 11 to rotate, so that the stack of cardboards on the conveyor wheel 11 is rotated with the conveyor wheel 11 accordingly and moved to achieve the effects of conveying and outputting the cardboards one by one, feeding the paper continuously and smoothly, and conveying the cardboards intermittently in cycles. When the grid plate 20 ascends, the grid plate 20 separates the contact between the next cardboard and the conveyor wheel 11, and the timing for elevating and descending the grid plate 20 is set according to the length of the cardboard and the conveying time interval. If the cardboard is situated at a stationary state, the grid plate 20 will wait till the next time of descending, and the conveyor wheel 11 will be rotated again for conveying the cardboard.

Figure 5:
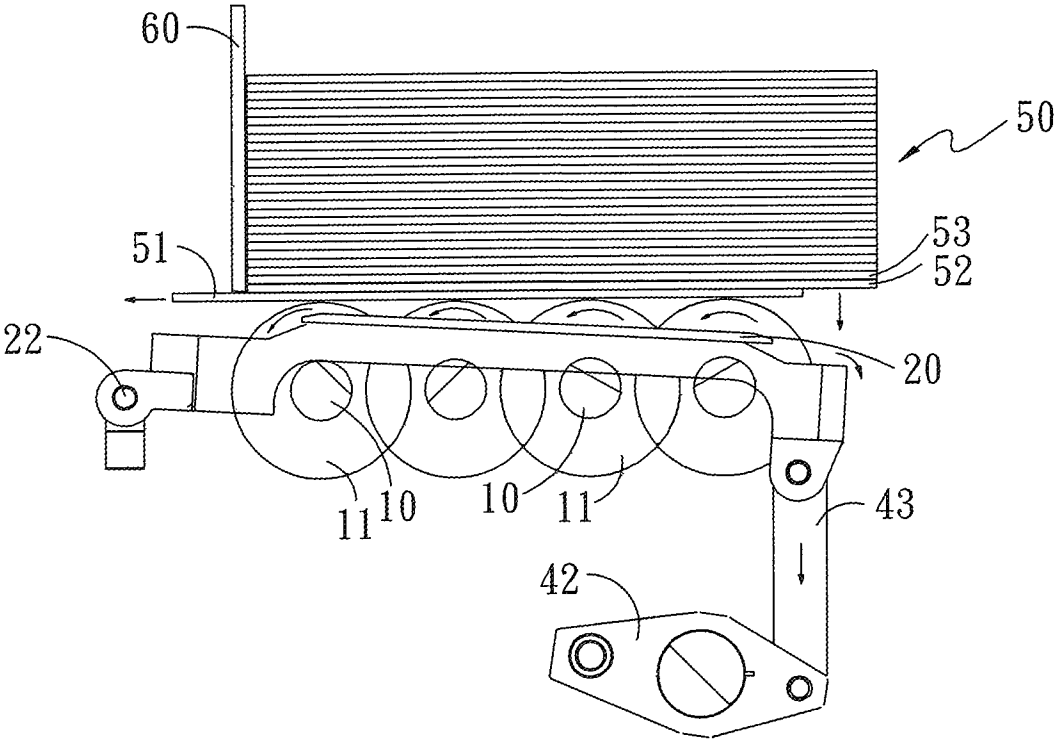
FIG. 5 is a schematic view showing a first status of conveying a cardboard of the present invention.
Figure 6:
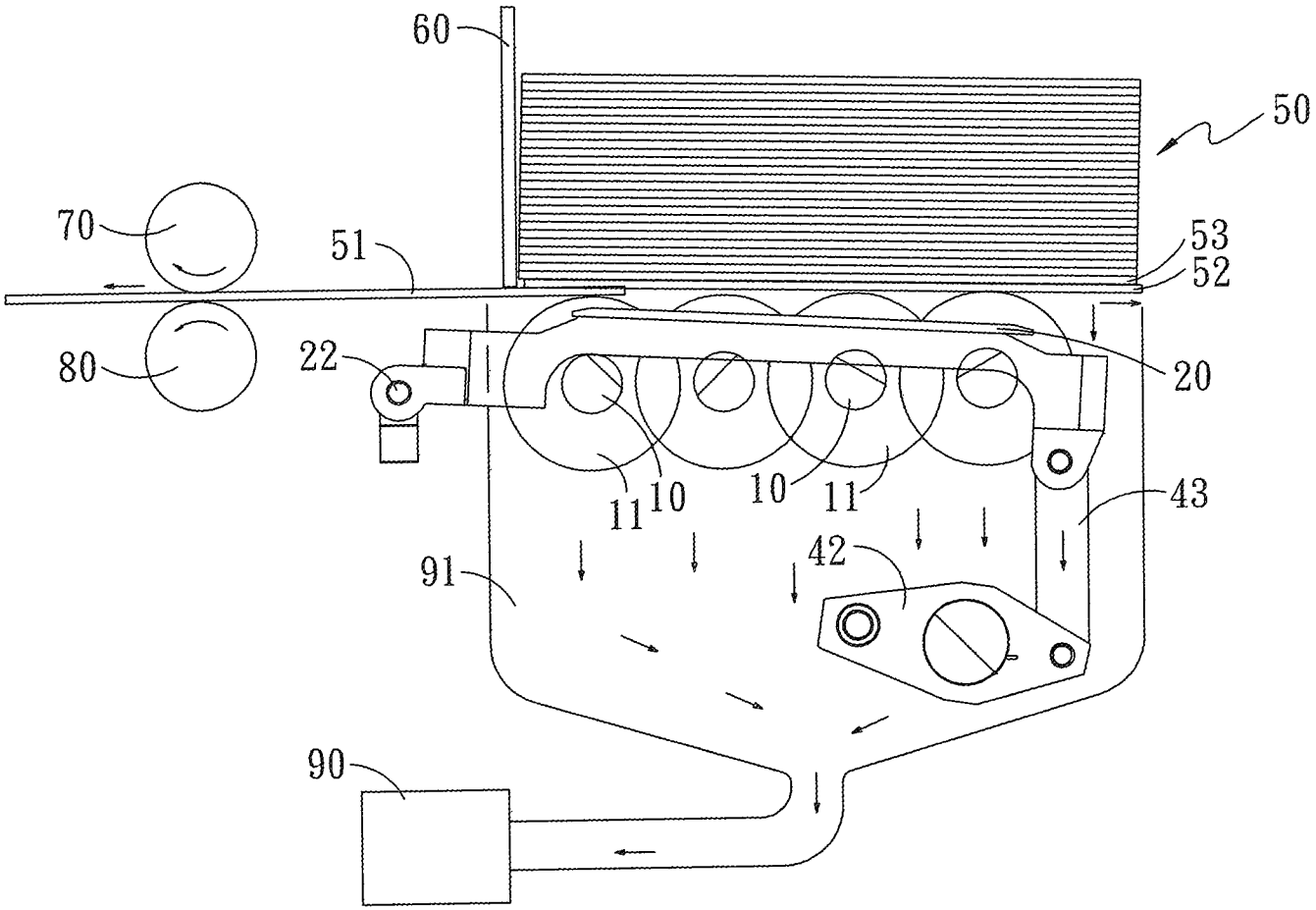
FIG. 6 is a schematic view showing a second status of conveying a cardboard of the present invention.

With reference to FIGS. 5 and 6 for another embodiment of the present invention, a baffle 60 is arranged at the grid plate 20 and proximate to a position above an edge of the shaft member 22, and a stack of cardboards 50 is outputted and the cardboards 50 are conveyed one by one in a direction towards the bottom of the baffle 60, and the stack of cardboards 50 is placed on the grid plate 20, so that a first cardboard 51 in the stack of cardboards 50 is in contact with the grid plate 20, and a second cardboard 52, a third cardboard 53 . . . are stacked and superimposed with one another on the first cardboard 51. In addition, the second cardboard 52 and the third cardboard 53 abut the baffle 60. The transmission shaft 10 is rotated in a direction of outputting the cardboards. When the grid plate 20 descends to a position such that the first cardboard 51 is in contact with the conveyor wheel 11, the transmission shaft 10 situated at the stationary state starts to rotate, and a maximum static friction produced between the first cardboard 51 and the conveyor wheel 11 drives the first cardboard to pass through the baffle 60 easily and to be outputted successfully (as shown in FIG. 5). In addition, the baffle 60 includes an upper paper feed roller 70 and a lower paper feed roller 80 installed opposite to the other side of the grid plate, and a gap is formed between the upper paper feed roller 70 and the lower paper feed roller 80, and the first cardboard 51 are engaged by the upper paper feed roller 70 and the lower paper feed roller 80 and conveyed continuously to a work station.

When the first cardboard 51 is outputted, the grid plate 20 is descended by using the axis of the shaft member 22 to rotate, so that the second cardboard 52 presses at the grid plate 20 due to the gravitational force of the stack of cardboards 50 and swings in an arc with the grid plate 20 to descend in a direction away from the baffle 60 and slide slantingly, so as to prevent possible deformations occurred at the edge of the second cardboard 52 due to the compression or friction from the baffle 60 and avoid unsmooth conveying. Further, a suction fan 90 is provided for producing suction by the suction box 91 to accelerate the second cardboard 52 to fall down and contact with the grid plate 20. After the first cardboard 51 is passed through the baffle 60 completely and sent out, the transmission shaft 10 will stop rotating, and a side of the grid plate 20 will be elevated by using the shaft member 22 as an axis, so as to prevent the second cardboard 52 from being in contact with the conveyor wheel 11 or prevent the second cardboard 52 from being sent out accidentally. The time interval or distance interval for conveying the first cardboard 51 and the second cardboard 52 may be controlled. The second cardboard 52 is sent by descending the grid plate 20 through rotation by using the shaft member 22 as the axis of rotation. When the second cardboard 52 is in contact with the conveyor wheel 11, the transmission shaft 10 situated at the stationary state starts rotating and repeat the cycle of conveying the second cardboard 52 similar to that of the first cardboard 51.

Figure 7:
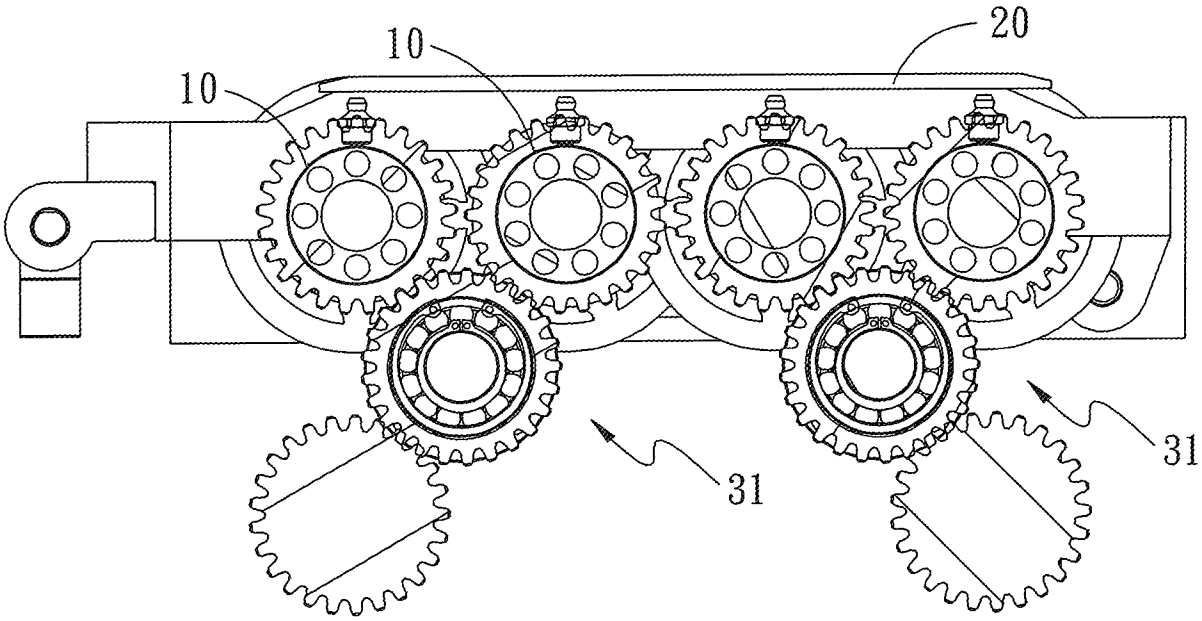
FIG. 7 is a schematic view of linking a transmission shaft of the present invention.

In FIG. 7, the servomotor 30 includes a gear set 31, and the servomotor 30 is linked to the transmission shaft 10 through the gear set 31, and the gear set 31 may be linked to two transmission shafts 10, and there may be two servomotors 30 for driving the operation of four transmission shafts 10. In addition, a regulator (not shown in the figure) is connected to the servomotor 30 and the control element 40 and provided for adjusting the intermittent movement speed of the servomotor 30 and the control element 40, so that cardboards of different sizes and lengths can be conveyed one by one smoothly within appropriate conveying time intervals.

In summation of the description above, the present invention improves over the prior art, and is thus duly filed for patent application. While the invention has been described by means of specific embodiments, numerous modifications and variations could be made thereto by those skilled in the art without departing from the scope and spirit of the invention set forth in the claims.

What is claimed is:

1. A front-edge paper feeding device, comprising:

a plurality of transmission shafts, arranged parallel to one another, and having a plurality of conveyor rollers respectively and axially installed to the transmission shafts;

a grid plate, covered onto the plurality of transmission shafts, and having a plurality of broken holes formed at positions corresponsive to the plurality of conveyor rollers respectively;

at least one servomotor, connected to the plurality of transmission shafts, for controlling the transmission shafts 10 to rotate intermittently;

a control element, connected to the grid plate, for controlling the grid plate to elevate and descend reciprocally; and a suction box, installed under the transmission shafts, wherein the control element includes a power shaft, a crank and a link lever, and the power shaft is linked to the crank, and the crank is linked to the link lever, and the link lever is linked to the grid plate, wherein the power shaft has an eccentric wheel pivotally connected to the power shaft, wherein the grid plate has an end connected to the control element, and the other end installed with a shaft member, and the axis of the shaft member acts as a fulcrum for rotation.

2. The front-edge paper feeding device as claimed in claim 1, wherein the servomotor includes at least one gear set.

3. The front-edge paper feeding device as claimed in claim 2, wherein the servomotor is linked to the transmission shaft through the gear set, and the gear set is linked to two transmission shafts.

4. The front-edge paper feeding device as claimed in claim 1, wherein the grid plate includes a baffle installed at an edge of the grid plate, and the baffle is arranged at the grid plate and proximate to a position above an edge of the shaft member.

5. The front-edge paper feeding device as claimed in claim 4, wherein the baffle has an upper paper feed roller and a lower paper feed roller installed on the other side opposite to the grid plate, and a gap is formed between the upper paper feed roller and the lower paper feed roller.

6. The front-edge paper feeding device as claimed in claim 4, wherein the suction box is connected to a suction fan.

7. The front-edge paper feeding device as claimed in claim 1, wherein the servomotor and the control element are connected to a regulator.

8. A front-edge paper feeding device, comprising:

a plurality of transmission shafts, arranged parallel to one another, and having a plurality of conveyor rollers respectively and axially installed to the transmission shafts;

a grid plate, covered onto the plurality of transmission shafts, and having a plurality of broken holes formed at positions corresponsive to the plurality of conveyor rollers, and the grid plate elevating and descending between the conveyor rollers, and a shaft member being installed at an end of the grid plate, and the axis of the shaft member acting as a fulcrum for rotation, and a baffle being disposed at an edge of the grid plate and arranged at the grid plate and proximate to a position above an edge of the shaft member;

at least one servomotor, including at least one gear set, and the servomotor being connected to the transmission shaft through the gear set for controlling an intermittent rotation of the transmission shaft, and the gear set being linked to two transmission shafts;

a control element, connected to the grid plate for controlling the grid plate to elevate and descend reciprocally, and the control element including a power shaft, a crank and a link lever, and an eccentric wheel being pivotally connected to the power shaft and linked to the crank, and the crank being linked to the link lever, and the link lever being linked to the grid plate;

a suction box, installed under the transmission shafts; an upper paper feed roller, installed on a side of the baffle and opposite to the other side of grid plate;

a lower paper feed roller, installed under the upper paper feed roller; and a regulator, connected to the servomotor and the control element.

* * * * *